US008323055B2

(12) United States Patent
Plate et al.

(10) Patent No.: US 8,323,055 B2
(45) Date of Patent: Dec. 4, 2012

(54) PLUG-IN CONNECTOR FOR CONNECTING TO A COAXIAL CABLE

(75) Inventors: Herbert Plate, Luedenscheid (DE); Brantley Natter, Brighton, MI (US)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 13/251,378

(22) Filed: Oct. 3, 2011

(65) Prior Publication Data

US 2012/0077376 A1 Mar. 29, 2012

Related U.S. Application Data

(63) Continuation of application No. PCT/EP2010/054230, filed on Mar. 30, 2010.

(30) Foreign Application Priority Data

Apr. 3, 2009 (DE) ..... 10 2009 016 227

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 4,131,332 | A | 12/1978 | Hogendobler et al. | |
| 4,377,320 | A * | 3/1983 | Lathrop et al. | 439/585 |
| 4,412,717 | A * | 11/1983 | Monroe | 439/582 |
| 4,619,496 | A | 10/1986 | Forney, Jr. et al. | |
| 4,645,288 | A * | 2/1987 | Stursa | 439/581 |
| 4,813,887 | A | 3/1989 | Capp | |
| 5,098,314 | A | 3/1992 | Castagna et al. | |
| 5,454,736 | A * | 10/1995 | Chou | 439/578 |
| 5,962,812 | A | 10/1999 | Miyazaki | |
| 5,965,847 | A | 10/1999 | Tanaka et al. | |
| 6,015,315 | A | 1/2000 | Ensign et al. | |
| 6,530,789 | B2 | 3/2003 | Konda | |
| 7,500,865 | B2 * | 3/2009 | Natter et al. | 439/362 |
| 7,598,455 | B2 | 10/2009 | Gump et al. | |
| 2001/0053633 | A1 | 12/2001 | Konda | |
| 2008/0214049 | A1 | 9/2008 | Gump et al. | |

FOREIGN PATENT DOCUMENTS

| | | | |
|---|---|---|---|
| DE | 69701065 | T2 | 9/2000 |
| DE | 102004024792 | A1 | 12/2005 |
| DE | 102006059496 | A1 | 6/2008 |
| DE | 102007009562 | A1 | 9/2008 |
| EP | 0841718 | A2 | 5/1998 |
| EP | 0993075 | A2 | 4/2000 |
| EP | 1168506 | A2 | 1/2002 |
| EP | 1965465 | A2 | 9/2008 |

* cited by examiner

*Primary Examiner* — Briggitte R Hammond
(74) *Attorney, Agent, or Firm* — Brooks Kushman P.C.

(57) ABSTRACT

A cable assembly includes a coaxial cable and a plug-in connector. The cable has inner and outer conductors and an insulation layer between the conductors. The connector has first and second tubular components. The first tubular component is inserted between the insulation layer and the outer conductor at a free end section of the cable and the second tubular component is connected to the first tubular component and encloses the outer conductor whereby the plug-in connector is connected to the cable. The second tubular component forms a sleeve that opens toward the free end section of the cable.

16 Claims, 4 Drawing Sheets

PLUG-IN CONNECTOR FOR CONNECTING TO A COAXIAL CABLE

CROSS-REFERENCE TO RELATED APPLICATIONS

This application is a continuation of International Application No. PCT/EP2010/054230, published in German, with an international filing date of Mar. 30, 2010, which claims priority to DE 10 2009 016 227.5, filed Apr. 3, 2009; the disclosures of which are incorporated by reference.

TECHNICAL FIELD

The present invention relates to a plug-in connector connectable to a coaxial cable having inner and outer conductors and insulation between the conductors in which a first tubular component is inserted between the insulation and the outer conductor on a free end section of the cable and a second tubular component is form-fit with the first tubular component while enclosing the outer conductor.

BACKGROUND

DE 697 01 065 T2 describes a connector device for electrically connecting the shielded layer of a shielded cable. An inner tubular component is guided under the laid open shielded layer and an outer tubular component. The outer tubular component is appended to the outside of the shielded layer. The tubular components can be connected to one another by sealing or locking means with the shielded layer being fastened between them. The design of the tubular components is relatively elaborate. It is unclear how the connector device as described might be used to fabricate an advantageously designed plug-in connector.

SUMMARY

An object of the present invention is a plug-in connector that can be connected to a coaxial cable in a simple and cost-effective manner and which enables effective electrically screening of a plug contact to be carried out simply.

In carrying out the above object and other objects, the present invention provides a cable assembly. The cable assembly includes a coaxial cable and a plug-in connector. The coaxial cable has inner and outer conductors and an insulation layer between the conductors. The plug-in connector has first and second tubular components. The first tubular component is inserted between the insulation layer and the outer conductor at a free end section of the coaxial cable and the second tubular component is connected to the first tubular component and encloses the outer conductor whereby the plug-in connector is connected to the coaxial cable. The second tubular component forms a sleeve that opens toward the free end section of the coaxial cable.

Also, in carrying out the above object and other objects, the present invention provides a plug-in connector (e.g., a plug-and-socket connector) for connecting to a coaxial cable having inner and outer conductors and an insulation layer between the conductors. The connector includes a first tubular component and a second tubular component. The first tubular component is insertable between the insulation layer and the outer conductor at a free end section of the coaxial cable and the second tubular component is connected to the first tubular component while being encloseable over the outer conductor whereby the connector is connectable to the coaxial cable. The second tubular component forms a sleeve.

The sleeve opens toward the free end section of the coaxial cable when the connector is connected to the coaxial cable.

Embodiments of the present invention are directed to a plug-in connector (e.g., a plug-and-socket connector) that can be connected to a coaxial cable. The coaxial cable includes an inner conductor, a braided outer conductor, and an insulation layer between the conductors. The coaxial cable further includes an outer protective sheath which encloses the outer conductor. The plug-in connector includes a first tubular component and a second tubular component. At a free end section of the coaxial cable, the first tubular component is inserted between the insulation layer and the outer conductor of the coaxial cable. The second tubular component is connected to the first tubular component in a form-closed manner so as to enclose the outer conductor. As such, the first and second tubular components sandwich the outer conductor where the tubular components are connected together. The second tubular component forms a sleeve that opens toward the free end section of the cable. The tubular components are connected together and sandwich the outer conductor up to the point where the sleeve of the second tubular component begins to form.

In accordance with embodiments of the present invention, the second tubular component forms a sleeve that is open toward the free end section of the coaxial cable. The sleeve extends up to the point over the region on which a plug contact is connected to the inner conductor of the coaxial cable. In an embodiment of the present invention, the sleeve covers the entire length of the plug contact. As the sleeve is electrically connected to the outer conductor of the coaxial cable, and thus lies at the screening potential, the sleeve optimally electrically screens the plug contact from all sides up to the free side remaining for inserting the mating plug.

In an embodiment of the present invention, instead of the sleeve extending over the entire plug contact, a shielding plate matched to the shape of the sleeve is provided. The shielding plate is custom fitted and surrounds the push-on sleeve contact to thereby protect against incoming and outgoing electromagnetic radiation.

In an embodiment of the present invention, an insulating chamber insert surrounds the plug contact. The chamber insert insulates the plug contact electrically from the sleeve. The chamber insert can be formed as a sleeve-shaped plastic unit. The chamber insert can be inserted as a custom fit element into the sleeve or the shielding plate.

In an embodiment of the present invention, the first tubular component has a groove around its circumference and the second tubular component has a bead around its circumference. The bead projects radially inwardly. The bead catches in the groove when the tubular components are brought together whereby the tubular components are rigidly connected to one another. The latching connection formed in this manner is simple and cost effective from a structural point of view.

In an embodiment of the present invention, the sleeve of the second tubular component has a bead. The bead is formed in the sleeve after the tubular components are brought together. The bead penetrates into the groove of the first tubular component such that the tubular components are connected together with a form-fit connection. The outer conductor of the coaxial cable is stretched tightly between the tubular components upon the tubular components being brought together such that a good electrical connection is made to both tubular components.

In an embodiment of the present invention, the first tubular component has a slot formed in the longitudinal direction. The slot enables the first tubular component to be compressed radially inwardly during insertion into the second tubular component. As a result, insertion of the first tubular component into the second tubular component is simplified and the first tubular component is well contained inside the second tubular component as the first tubular component is under spring tension. The elastic latching action concurrently enables a matching of tolerances comparable to the dimensions of the tubular components. It also enables the first tubular component to be pressed together a bit in the radial direction whereby the inner conductor of the coaxial cable is tightly clamped and the first tubular component is securely connected to the coaxial cable. This enables additional mechanical stress relief of the coaxial cable to be eliminated.

The above features, and other features and advantages of the present invention are readily apparent from the following detailed description thereof when taken in connection with the accompanying drawings.

DETAILED DESCRIPTION

Figure 1:
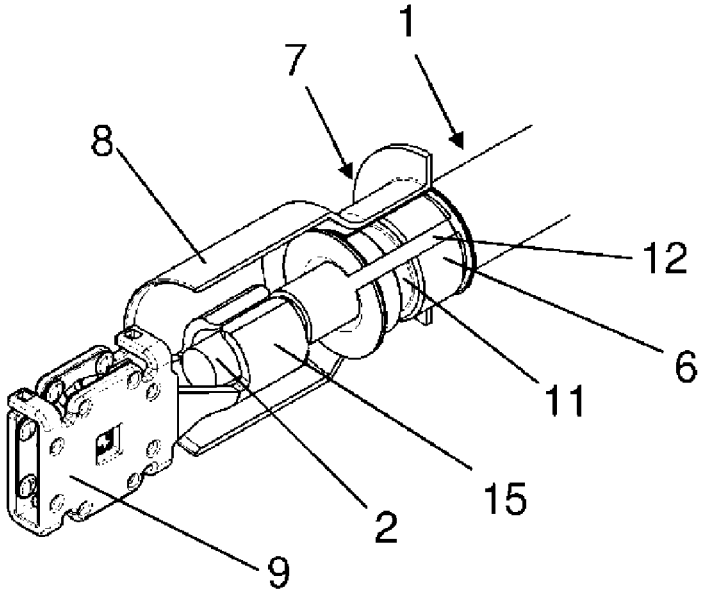
FIG. 1 illustrates a perspective view of a free end section of a coaxial cable of a cable assembly with a plug-in connector of the cable assembly connected at the free end section of the coaxial cable in accordance with an embodiment of the present invention.
Figure 2:
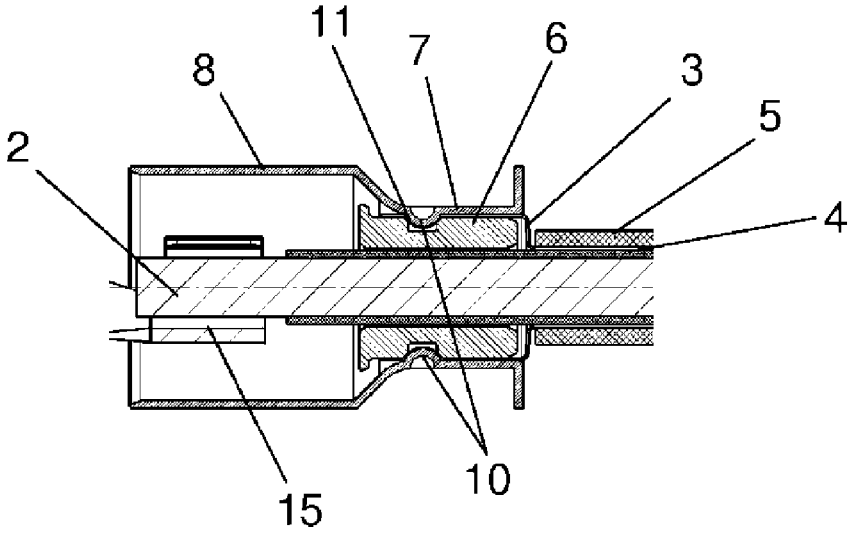
FIG. 2 illustrates a cross-sectional longitudinal view of the free end section of the coaxial cable of the cable assembly shown in FIG. 1.

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring now to FIG. 1 through FIG. 6, a cable assembly in accordance with an embodiment of the present invention will be described. The cable assembly includes a coaxial cable 1 and a plug-in connector (e.g., a plug-and-socket connector). The plug-in connector is connectable to a free end section of coaxial cable 1.

Coaxial cable 1 includes an inner electrical conductor 2 and an outer electrical conductor 3. Inner and outer conductors 2 and 3 run along the length of coaxial cable 1 and are radially separated from one another. Outer conductor 3 is a braided metal. Coaxial cable 1 further includes an insulation layer 4. Insulation layer 4 runs between conductors 2 and 3 along the length of coaxial cable 1. Coaxial cable 1 further includes an outer protective sheath 5. Protective sheath 5 encloses outer conductor 3, and thereby also encloses inner conductor 2 and insulation layer 4, over the length of coaxial cable 1.

The plug-in connector includes a first tubular component 6 and a second tubular component 7. As shown, for example in FIG. 1, the plug-in connector connects to the free end section of coaxial cable 1. To this end, first tubular component 6 is attached to coaxial cable 1. First tubular component 6 is also inserted into second tubular component 7 and is latched with second tubular component 7. Second tubular component 7 forms a sleeve 8. Sleeve 8 opens in the direction of the free end section of coaxial cable 1.

Inner conductor 2 of coaxial cable 1 is configured to be connected with a plug contact. As shown in FIG. 1, a plug contact 9 is connected to inner conductor 2 via a crimped connection 15 at a connection point. Plug contact 9 is illustrated as an exemplary push-on sleeve that can accept a flat pin contact from various insertion directions. Sleeve 8 surrounds the connection point between inner conductor 2 and plug contact 9.

Insulation layer 4 encloses inner conductor 2 up to the section of crimped connection 15 between inner conductor 2 and plug contact 9. Protective sheath 5 extends along the length of coaxial cable 1 up to where tubular components 6 and 7 are connected to one another at the free end section of coaxial cable 1. Outer conductor 3 extends further then protective sheath 5 toward the free end section of coaxial cable 1 and past where tubular components 6 and 7 are connected to one another. This extended portion of outer conductor 3 is stretched between tubular components 6 and 7. As the plug-in connector may be used as a high-capacity plug-in connector that can carry high electrical voltages and/or currents, inner conductor 2 has a relatively large cross-sectional area.

First tubular component 6 includes a groove 11. Groove 11 is formed circumferentially along the outer edge of first tubular component 6. Second tubular component 7 includes a corresponding bead 10. Bead 10 is formed around the circumference of second tubular component 7 and projects radially inwardly. Bead 10 catches and engages in groove 11 in a latching manner when tubular components 6 and 7 are brought together. As a result of the engagement between bead 10 and groove 11, tubular components 6 and 7 are rigidly connected to one another.

First tubular component 6 further includes a slot 12. Slot 12 runs longitudinally along the length of first tubular component 6 as shown, for example, in FIG. 1. Slot 12 enables first tubular component 6 to be compressed radially inwardly. The latching engagement between bead 10 and groove 11 is assisted by first tubular component 6 compressing radially inwardly due to slot 12. As the inner diameter of first tubular component 6 is reduced in this manner, first tubular component 6 closes rigidly about insulation layer 4 of coaxial cable 1. Likewise, outer conductor 3 is rigidly secured between first and second tubular components 6 and 7. Coaxial cable 1 is thereby rigidly connected with tubular components 6 and 7.

Figure 3:
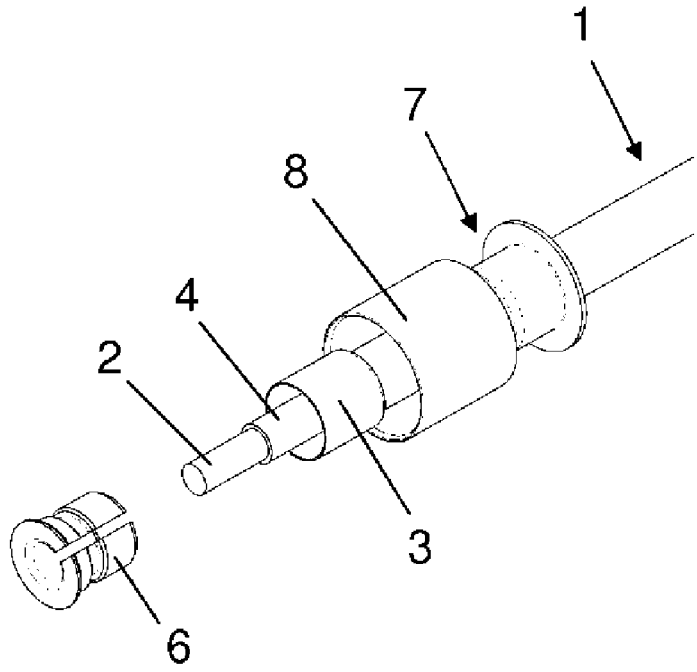
FIG. 3 illustrates a perspective view of an initial assembly step for connecting the plug-in connector to the free end section of the coaxial cable of the cable assembly shown in FIG. 1.
Figure 4:
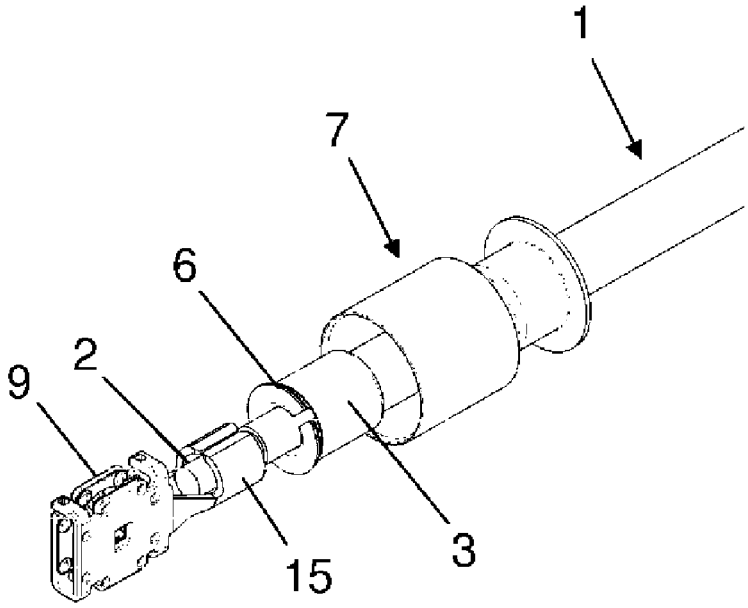
FIG. 4 illustrates a perspective view of a final assembly step for connecting the plug-in connector to the free end section of the coaxial cable of the cable assembly shown in FIG. 1.

Assembly steps for connecting the components of the plug-in connector to coaxial cable 1 are shown in FIGS. 3 and 4. Insulation layer 4 and protective sheath 5 of coaxial cable 1 are initially removed on an end section of coaxial cable 1 at the required length. Second tubular component 7 is then slid over coaxial cable 1. The metallic braiding of outer conductor 3 of coaxial cable 1 is then expanded radially and first tubular component 6 is shoved under outer conductor 3 and over insulation layer 4. After forming crimped connection 15 between plug contact 9 and inner conductor 2 of coaxial cable 1, the cable assembly reaches a final state depicted in FIG. 4.

Second tubular component 7 is shoved over first tubular component 6 in the final state of the cable assembly. Tubular components 6 and 7 latch with one another and concurrently produce the electrical connection between second tubular component 7 and outer conductor 3 as second tubular component 7 is shoved over first tubular component 6. A mechanically stable connection between the plug-in connector and coaxial cable 1 and electrical screening up to the connection region of plug contact 9 and inner conductor 2 are thereby achieved.

Figure 5:
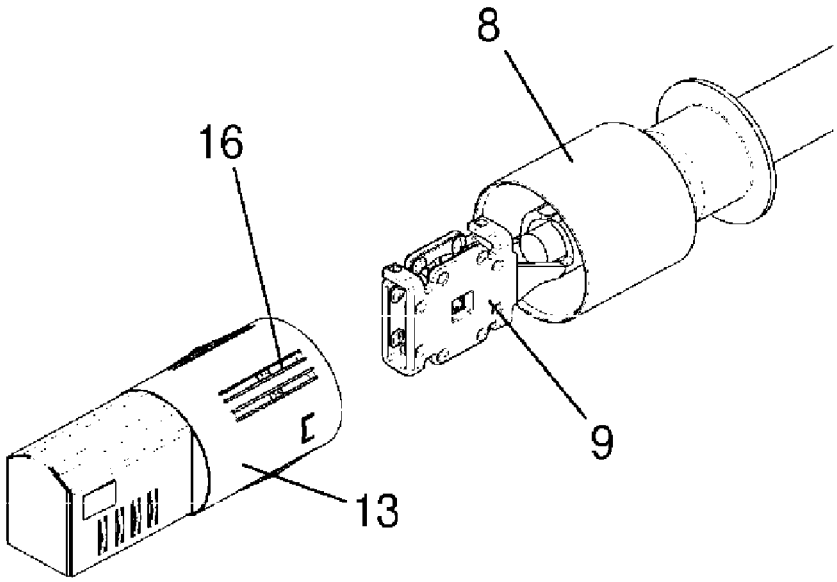
FIG. 5 illustrates a perspective view of a shielding plate and the free end section of the coaxial cable of the cable assembly shown in FIG. 1 in which the shielding plate is to be inserted into the sleeve of the second tubular component of the plug-in connector.
Figure 6:
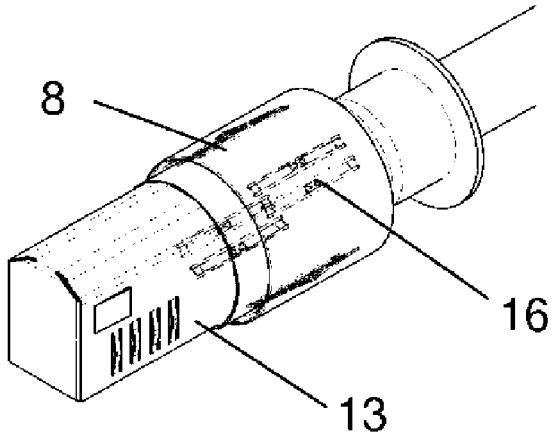
FIG. 6 illustrates a perspective view the shielding plate and the free end section of the coaxial cable of the cable assembly shown in FIG. 1 in which the shielding plate is inserted into the sleeve of the second tubular component of the plug-in connector.

With reference to FIGS. 5 and 6, a shielding plate 13 can be inserted into sleeve 8 formed by second tubular component 7. Shielding plate 13 is to produce a nearly complete electrical screening of plug contact 9. Shielding plate 13 surrounds plug contact 9 by releasing only one insertion opening for adding a mating contact and shields plug contact 9 against incoming and outgoing electromagnetic radiation.

Shielding plate 13 has elastically formed contact sections 16. Contact sections 16 produce a relatively strong electrical and mechanical connection with sleeve 8. An insulating chamber insert (not shown) having a shape similar to screening shield 13 can be inserted into the hollow space inside shielding plate 13 to electrically insulate plug contact 9 from shielding plate 13.

In FIG. 6, shielding plate 13 is inserted into sleeve 8. The front section of shielding plate 13 has a recess on its lower side (not shown). A flat-pin can be connected through the recess of shielding plate 13 as the mating contact with plug contact 9 inside shielding plate 13.

Figure 7:
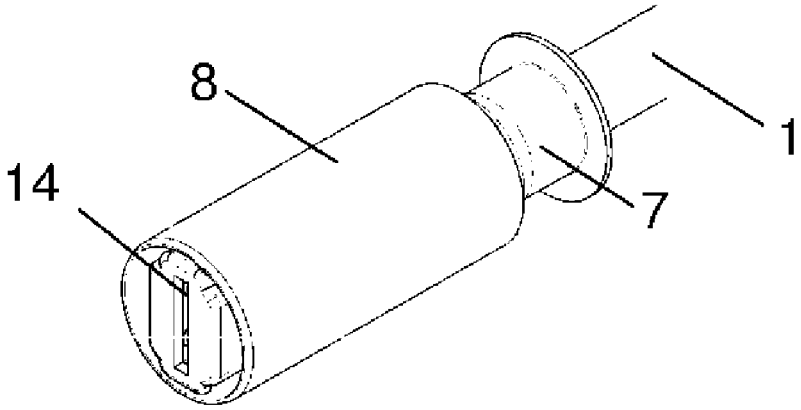
FIG. 7 illustrates a perspective view of a free end section of a coaxial cable of a cable assembly with a plug-in connector of the cable assembly connected at the free end section of the coaxial cable in accordance with another embodiment of the present invention.

Referring now to FIG. 7, with reference to FIG. 1 through FIG. 6, a cable assembly in accordance with another embodiment of the present invention is shown. The direction of insertion of the mating connector that can be added is provided in the axial direction of sleeve 8 of second tubular component 7. Due to the non-angled direction of insertion, the screening of plug contact 9 can take place only through extended sleeve 8 of second tubular component 7 so that additional shielding plate is not required. An insulating chamber insert 14 is inside sleeve 8. Chamber insert 14 insulates plug contact 9 electrically from sleeve 8.

REFERENCE LIST

1 coaxial cable
2 inner conductor
3 outer conductor
4 insulation
5 protective sheath
6 first tubular component
7 second tubular component
8 sleeve
9 plug contact
10 bead
11 groove
12 slot
13 shielding plate
14 chamber insert
15 crimped connection
16 contact sections While exemplary embodiments are described above, it is not intended that these embodiments describe all possible forms of the present invention. Rather, the words used in the specification are words of description rather than limitation, and it is understood that various changes may be made without departing from the spirit and scope of the invention. Additionally, the features of various implementing embodiments may be combined to form further embodiments of the present invention.

What is claimed is:

1. A cable assembly comprising:

a coaxial cable having inner and outer conductors and an insulation layer between the conductors; and a plug-in connector having first and second tubular components, wherein one of the tubular components has a groove that extends around at least part of the circumference of the one of the tubular components and projects radially inwardly, wherein the other one of the tubular components has a bead that projects radially inwards;

wherein the first tubular component is inserted between the insulation layer and the outer conductor at a free end section of the coaxial cable and the second tubular component is connected to the first tubular component and encloses the outer conductor whereby the plug-in connector is connected to the coaxial cable;

wherein the second tubular component forms a sleeve that opens toward the free end section of the coaxial cable;

wherein the bead of the other one of the tubular components radially extends into and is latched with the groove of the one of the tubular components such that the tubular components are connected together via the latching of the bead with the groove;

wherein the tubular components are connected together and sandwich the outer conductor up to where the sleeve of the second tubular component begins to form with the outer conductor being sandwiched between the groove of the one of the tubular components and the bead of the other one of the tubular components.

2. The assembly of claim 1 wherein:

the first tubular component has a slot running along the first tubular component, wherein the slot enables the first tubular component to be compressed radially inwardly during insertion of the first tubular component between the insulation layer and the outer conductor at the free end of the coaxial cable.

3. The assembly of claim 1 wherein:

the outer conductor is braided.

4. The assembly of claim 1 wherein:

the inner conductor is connected to a plug contact;

wherein the sleeve of the second tubular component encloses the connection between the inner conductor and the plug contact.

5. The assembly of claim 4 wherein:

the connection between the inner conductor and the plug contact is a crimped connection.

6. The assembly of claim 4 further comprising:

an insulating chamber insert between the sleeve of the second tubular component and the plug contact.

7. The assembly of claim 4 further comprising:

a shielding plate enclosing the plug contact at least partially in the opening of the sleeve of the second tubular component.

8. The assembly of claim 7 wherein:

the shielding plate is integrally formed from a sheet metal strip.

9. A plug-in connector for connecting to a coaxial cable having inner and outer conductors and an insulation layer between the conductors, the connector comprising:

a first tubular component, the first tubular component having a groove that extends around at least part of the circumference of the first tubular component and projects radially inwardly; and a second tubular component, the second tubular component having a bead that projects radially inwards;

wherein the first tubular component is insertable between the insulation layer and the outer conductor at a free end section of the coaxial cable and the second tubular component is connectable to the first tubular component while being encloseable over the outer conductor whereby the connector is connectable to the coaxial cable;

wherein the second tubular component forms a sleeve, wherein the sleeve opens toward the free end section of the coaxial cable when the connector is connected to the coaxial cable;

wherein the bead of the second tubular component is radially extendible into and latch-able with the groove of the first tubular component such that the first and second tubular components connect together via the latching of the bead with the groove;

wherein the tubular components are connected together and sandwich the outer conductor up to where the sleeve of the second tubular component begins to form with the outer conductor being sandwiched between the bead of the second tubular component and the groove of the first tubular component when the connector is connected to the coaxial cable.

10. The connector of claim 9 wherein:

the inner conductor is connected to a plug contact;

wherein the sleeve of the second tubular component encloses the connection between the inner conductor and the plug contact when the connector is connected to the coaxial cable.

11. The connector of claim 9 wherein:

the first tubular component has a slot running along the first tubular component, wherein the slot enables the first tubular component to be compressed radially inwardly during insertion of the first tubular component between the insulation layer and the outer conductor at the free end of the coaxial cable when the connector is connected to the cable.

12. The connector of claim 9 wherein:

the outer conductor is braided.

13. The connector of claim 10 further comprising:

a shielding plate enclosing the plug contact at least partially in the opening of the sleeve of the second tubular component.

14. The connector of claim 13 wherein:

the shielding plate is integrally formed from a sheet metal strip.

15. The connector of claim 10 wherein:

the connection between the inner conductor and the plug contact is a crimped connection.

16. The connector of claim 10 further comprising:

an insulating chamber insert between the sleeve of the second tubular component and the plug contact.

* * * * *